United States Patent [19]

Hardman et al.

[11] 4,357,224

[45] Nov. 2, 1982

[54] ENERGY EFFICIENT ELECTROLYZER FOR THE PRODUCTION OF HYDROGEN

[75] Inventors: Carl C. Hardman, Pittsburgh; George R. Folser, Lower Burrell, both of Pa.

[73] Assignee: Westinghouse Electric Corp., Pittsburgh, Pa.

[21] Appl. No.: 251,791

[22] Filed: Apr. 7, 1981

[51] Int. Cl.[3] ..... C25B 9/00; C25B 11/03; C25B 11/04; C25B 11/10

[52] U.S. Cl. ..... 204/255; 204/290 F; 204/294; 204/296; 204/283

[58] Field of Search ..... 204/254–256, 204/129, 294, 283, 295–296

[56] References Cited

U.S. PATENT DOCUMENTS

| | | | |
|---|---|---|---|
| 2,181,891 | 12/1939 | Hazell | 204/296 X |
| 3,919,062 | 11/1975 | Lundquist, Jr. et al. | 204/255 X |
| 4,302,320 | 11/1981 | Lewis | 204/294 X |
| 4,312,736 | 1/1982 | Menth et al. | 204/255 |

FOREIGN PATENT DOCUMENTS

| | | | |
|---|---|---|---|
| 1011855 | 7/1957 | Fed. Rep. of Germany | 204/256 |
| 2104198 | 8/1972 | Fed. Rep. of Germany | 204/255 |
| 39-27102 | 11/1964 | Japan | 204/256 |

*Primary Examiner*—Donald R. Valentine
*Attorney, Agent, or Firm*—R. D. Fuerle

[57] ABSTRACT

Disclosed is an energy efficient electrolyzer for the production of hydrogen. The electrolyzer consists of an inner container, a plurality of electrolytic cells within the container and means for passing electric current in series through the electrolytic cells. Each cell consists of the anode half of one inert impervious conducting bipolar plate, in contact with an inert conductive anode bed of large surface area separated from the facing cathode half of another inert impervious conducting bipolar plate by a porous insulating separator. The anode is impregnated with an anolyte of about 10 to about 60% aqueous sulfuric acid saturated with sulfur dioxide and the cathode is bathed in a catholyte of about 10 to about 60% aqueous sulfuric acid. The anode is preferably carbon pellets which have been obtained from vegetable matter and which contain about 1 to about 5% platinum.

15 Claims, 1 Drawing Figure

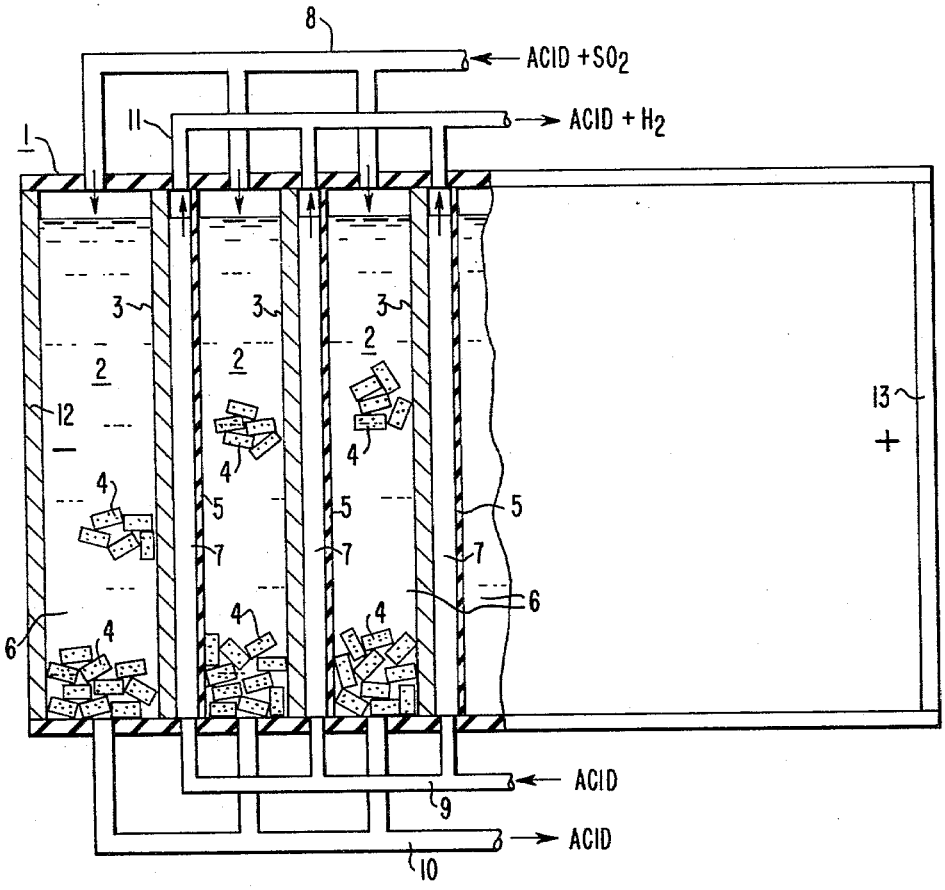
8
ACID +SO2
11
ACID + H2
1
3
2
12
13
4
5
7
6
ACID
9
10

ENERGY EFFICIENT ELECTROLYZER FOR THE PRODUCTION OF HYDROGEN

BACKGROUND OF THE INVENTION

The production of the hydrogen for fuel and chemical processing is becoming an increasingly important function in the economy. Until recently, most low-cost hydrogen was produced from fuels, but as the price of fuels increased this method has become less economical. Another method of producing hydrogen is by electrolysis, and recently this method has become more competitive with hydrogen production from fuels even through it is very energy intensive due to the high heat of formation of water. The minimum theoretical voltage for the decomposition of water is 1.23 volts but the actual voltage is at least 1.8 volts because of cell resistance at realistic current densities.

Brecher and Wu U.S. Pat. No. 3,888,750 discloses a process for evolving hydrogen cathodically without the simultaneous evolution of oxygen at the anode. The overall cell reaction for this process is $H_2SO_3 + H_2O \rightarrow H_2SO_4 + H_2$ where the voltage for the reaction is 0.17 volts in about 5% sulfuric acid (0.35 V in 50% acid). Since this reaction in theory requires 14% of the energy in the usual electrolysis reaction and yields no less hydrogen per ampere hour, the process is inherently very attractive.

However, a close study of the system shows that the anodic reaction $$HSO_3^- + H_2O \rightarrow HSO_4^- + 2H^+ + 2e^-$$

which requires the oxidation of the bisulfite ion, $HSO_3^-$, to the bisulfate ion, $HSO_4^-$, may occur with difficulty because the sulfurous acid formed by dissolving sulfur dioxide in an aqueous solution of sulfuric acid is only slightly ionized to form the bisulfite ion in the presence of the stronger, and much more concentrated, sulfuric acid. Thus the bisulfite ion, produced by sulfurous acid, is present at a much lower concentration than the sulfate ion and the bisulfate anion, produced by sulfuric acid. The anode, as the positive electrode, attracts all the anions but does not have a high enough potential to oxidize the sulfate anion and the bisulfate anion. These two ions provide an essentially permanent blanket layer surrounding the anode and block the access of the bisulfite ion to the anode. In addition, since there is no gas evolved at the anode there is no turbulence that would provide fresh access to the anodic surface. These difficulties greatly lower the efficiency of the electrolytic cell.

PRIOR ART

U.S. Pat. No. 3,888,750 to Brecher and Wu discloses a process for electrolytically decomposing water to produce hydrogen and oxygen ion in concentrated sulfuric acid. The process of this invention is an improvement on the Brecher and Wu process.

U.S. Pat. No. 3,856,574 discloses the use of hollow carbon microspheres in a carbonized matrix as an electrode in fuel and air cells. The carbon is not used in sulfuric acid, but rather is used in ammonium chloride or potassium hydroxide.

SUMMARY OF THE INVENTION

We have discovered that an anode having a high surface area, formed from packed porous carbon pellets pressed tightly against an inert current collector, is very efficient in permitting access of the bisulfite ion to the anode. It is surprising that carbon pellets would perform satisfactorily in concentrated sulfuric acid because since sulfuric acid cannot be further oxidized, a damaging alternative reaction, such as oxygen evolution which is very corrosive to carbon, would be expected to occur at the anode. Also, the bisulfate ion forms an intercalation compound such as graphite bisulfate which might be expected to split a carbon anode.

Nevertheless, we have discovered that carbon does in fact work very well in this particular application in combination with an inert impervious conducting bipolar plate and a porous insulating separator. The electrolyzer of this invention is much more energy efficient than the electrolyzers described in the previous Wu and Brecher patent.

DESCRIPTION OF THE INVENTION

The accompanying drawing is a partially cut away side view of a certain presently preferred embodiment of an electrolyzer according to this invention.

In the drawing a container 1 holds a multiplicity of electrolytic cells 2. Each cell 2 consists of two facing halves of two different impervious conducting bipolar plates 3, a bed of porous graphite pellets 4, which form the anode, and a porous insulating separator 5. The porous graphite pellets are immersed in an anolyte 6 of concentrated sulfuric acid saturated with sulfur dioxide. Between porous insulating separator 6 and bipolar plate 3 is a catholyte 7 of concentrated sulfuric acid. Fresh anolyte is admitted to each cell through manifold 8 and fresh catholyte is admitted to each cell through manifold 9. Exhausted anolyte is removed from each cell through manifold 10 and exhausted catholyte and hydrogen gas is removed from each cell through manifold 11. An electric current is passed through the cell from left to right through electrical contacts 12 and 13.

Because the sulfate and bisulfate ions are in the majority and tend to blanket the anode they prevent the bisulfate ion from reaching the anode to be oxidized. It is therefore necessary that the anode bed have as much surface area as possible, preferably in excess of 10 $m^2/g$. The carbon is effective because it combines porosity, which means a large specific volume of reservoir anolyte, with high specific surface for contact with the desired anion. The reservoir anolyte is an interface between the flowing, renewal anolyte that bathes the porous carbon and the anode with its film of bound-by-attractive forces of unoxidizable anions (i.e., sulfate and bisulfate). The large surface area created by the bed of carbon pellets insures adequate diffusion of the required bisulfite anion to keep the reservoir anolyte concentrated enough to insure a large enough probability that sufficient anions are oxidized at a potential value that is economically attractive.

While platinum black and other substances having a large surface area could be used as anodic materials, they lack the interior reservoir properties just described. The best carbon for this purpose is activated carbon, particularly activated carbon which has been obtained from vegetable matter as it is a very highly porous type of carbon. The effectiveness of the carbon can be increased, however, if about 1 to about 5% (all percentages herein are by weight) platinum powder is mixed into the carbon. While the same effect can be obtained by using additional carbon for the anode, it is preferred to use carbon with the platinum mixed in as the platinum does not wear out and it enables the entire electrolytic cell to be made smaller. The best form for the carbon seems to be as cylindrical pellets, and about $\frac{1}{8}$ to $\frac{1}{4}$ inch diameter pellets is a suitable size. Whatever material is chosen for the anode it must be an inert conductor, have a very high surface area, and should also be porous.

The electrode must be bipolar so that any number of cells may be stacked together. An inert impervious conducting plate is required for use as the bipolar electrode. Platinum or gold are suitable materials for this electrode but the preferred material is a titanium sheet coated with titanium dioxide and other oxides because this material functions best in the concentrated sulfuric acid electrolyte. A bipolar plate about 10 to about 20 mils thick is appropriate.

The purpose of the separator is to keep the sulfur dioxide gas and the bisulfite ion away from the cathode to prevent their reduction to elemental sulfur which would diminish the effectiveness of the cell. The separator need not be impervious if hydrostatic pressure is maintained on the cathode side to prevent the flow of liquid through the separator to the cathode. Indeed, the separator must not stop the flow of current through the cells as it must be porous to the flow of ions. However, the preferred separator is a microporous rubber membrane about 20 to about 30 mils thick as there is less voltage drop across a microporous rubber membrane than across an ion exchange membrane, the alternative separator.

The container of the electrolyzer can be made of any material which is inert to the concentrated sulfuric acid solution under the conditions of use. Polytetrafluoroethylene and many other plastics are suitable for this purpose.

The electrolyte consits of the anolyte which surrounds the anode and the catholyte which surrounds the cathode. Both the anolyte and the catholyte consist of about 10 to about 60% concentrated sulfuric acid in water. If less than 10% sulfuric acid is used, the cell resistance builds up which generates heat and reduces the effectiveness of the cell. If more than 60% concentrated sulfuric acid is used, the resistance of the cell again goes up and the potential necessary to oxidize sulfur dioxide also increases. The best sulfuric acid concentration at which to operate the cell is about 10 to about 20% but because the cell is only a part of a total process for decomposing water it is preferred to operate the cell using 45 to 55% sulfuric acid as this reduces the amount of water which must be evaporated to obtain the 100% sulfuric acid, which is then decomposed to form sulfur dioxide which is recycled in the process. The anolyte differs from the catholyte in that it is saturated with sulfur dioxide, preferably at a pressure of about 1 to about 12 atmospheres, to increase the concentration of bisulfite ion. If a rubber separator is used or another separator which is not impervious to the bisulfite ion or to sulfur dioxide, it is necessary to maintain pressure on the catholyte of about 0.1 to about 0.2 psi greater than the pressure on the anolyte. Also, it is desirable to maintain the temperature of the anolyte at between about 20° and about 60° C. as heating reduces $SO_2$ solubility. But since temperature increases conductivity which decreases cell voltage, this temperature range is the best compromise of these opposing considerations. Bisulfite ion can be formed by the dissolution of sulfur dioxide in water according to the equation $$SO_2+2H_2O \rightarrow H_2SO_3+H_2O \rightleftharpoons H_3O^+ + HSO_3^-$$

As the cell operates, the bisulfite ion is oxidized to bisulfite ion according to the reaction $$HSO_3^- + H_2O \rightarrow HSO_4^- + 2H^+ + 2e^-$$

This results in a buildup of bisulfate ion around the anode which by its presence restricts the available anode surface for continued oxidation of bisulfite ion at a desirable potential. As defined by Nernst, the potential of an electrode reaction is a logarithmic function of the ion concentration of the reactant species. Sulfuric acid builds up at the cathode and must also be flushed out to reduce the concentration of sulfuric acid to an appropriate level. The exchange of exhausted anolyte and catholyte for fresh anolyte and catholyte is preferably accomplished by a gravity feed. A pump can also be used for this purpose but a gravity feed is preferable as pump failure may result in damage to the cell if the bisulfite ion is seriously depleted.

The electrolyzer typically consists of about 50 to about 500 individual cells in series. The amount of hydrogen produced by the electrolyzer is a function of the current density. A cell can generally be operated at a current density of about 1000 to about 3000 amperes per meter squared to produce about 420 to about 1200 liters of hydrogen per hour, respectively.

The following examples further illustrate this invention.

EXAMPLE

To test the concept of this invention, a three-cell electrolyzer was built using the impervious bipolar plates, carbon pellets, and microporous rubber separator as described herein.

The cell area was 25 sq. cm., and at 5000 mA (200 $mA/cm^{-1}$); the cell voltage was 600 mv for electrode potential and 350 mv for IR drop between bipolar plates. This latter value is somewhat higher than planned because the microporous rubber separator available was twice as thick as it need be (45 mils). The cell conditions were 50° C., 50% $H_2SO_4$ and one atmosphere pressure. Extrapolation at cell voltage to zero current density gives 0.45 volts/cell. An electrolyzer of usual design would give 1.23 volts on extrapolation to zero current density.

We claim:

1. An electrolyzer for the production of hydrogen comprising:
   (1) an inert container;
   (2) a plurality of electrolytic cells within said container, each comprising
      (A) the anode half of one inert impervious conducting bipolar plate and the facing cathode half of another inert impervious conducting bipolar plate;
      (B) an inert conductive anode bed of porous activated carbon pellets of large surface area on said anode half of said bipolar plate, said anode bed being impregnated with an anolyte which comprises about 10 to about 60% aqueous sulfuric acid saturated with sulfur dioxide;
      (C) a porous separator, between said anode bed and said cathode half; and
      (D) a catholyte which comprises about 10 to about 60% aqueous sulfuric acid between said separator and said cathode half.

2. An electrolyzer according to claim 1 wherein said separator is a microporous rubber membrane about 20 to about 30 mils thick.

3. An electrolyzer according to claim 1 wherein said carbon pellets are obtained from vegetable matter.

4. An electrolyzer according to claim 1 wherein said carbon pellets contain about 1 to about 5% platinum.

5. An electrolyzer according to claim 1 wherein said carbon pellets are about $\frac{1}{8}$ to about $\frac{1}{4}$ inches in size.

6. An electrolyzer according to claim 1 wherein said bipolar plate is titanium coated with metal oxides.

7. An electrolyzer according to claim 1 wherein said sulfur dioxide is under a pressure of about 1 to about 12 atmospheres.

8. An electrolyzer according to claim 1 wherein the concentration of said sulfuric acid is about 45 to about 55%.

9. An electrolyzer according to claim 1 wherein the concentration of said sulfuric acid is about 10 to about 20%.

10. An electrolyzer according to claim 1 including means for continually draining said anolyte and for continually adding fresh anolyte and means for draining said catholyte and for adding fresh catholyte.

11. An electrolyzer according to claim 10 wherein said anolyte and catholyte are added and drained by gravity.

12. An electrolyzer according to claim wherein the temperature of said anolyte is maintained at about 20° to about 60° C.

13. An electrolyzer according to claim 1 wherein the number of said electrolytic cells is about 50 to about 500 cells.

14. An electrolyzer according to claim 1 wherein said electrode bipolar plate is about 10 to about 20 mils thick.

15. An electrolyzer according to claim 1 wherein said anode bed has a surface area in excess of 10 $m^2/g$.

* * * * *